US009416586B1

(12) United States Patent
Ory, Jr.

(10) Patent No.: US 9,416,586 B1
(45) **Date of Patent: *Aug. 16, 2016**

(54) TRIANGULAR FLANGE BRACKET FOR ATTACHING CORNERS OF TRANSPARENT PLASTIC PANELS OVER WINDOWS AND DOOR OPENINGS

(71) Applicant: Cyprexx Services, LLC, Brandon, FL (US)

(72) Inventor: Ronald J. Ory, Jr., LaPlace, LA (US)

(73) Assignee: Cyprexx Services, LLC, Brandon, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/947,217

(22) Filed: Nov. 20, 2015

Related U.S. Application Data

(63) Continuation of application No. 14/583,400, filed on Dec. 26, 2014, now Pat. No. 9,217,276.

(60) Provisional application No. 61/921,213, filed on Dec. 27, 2013.

(51) Int. Cl.

| | |
|---|---|
| ***E06B 3/28*** | (2006.01) |
| ***E06B 5/11*** | (2006.01) |
| ***E06B 3/30*** | (2006.01) |
| ***E04B 1/92*** | (2006.01) |
| *E06B 9/00* | (2006.01) |
| *E06B 9/01* | (2006.01) |

(52) U.S. Cl.
CPC ... *E06B 5/11* (2013.01); *E04B 1/92* (2013.01); *E06B 3/30* (2013.01); *E06B 5/116* (2013.01); *E06B 2009/002* (2013.01); *E06B 2009/005* (2013.01); *E06B 2009/015* (2013.01)

(58) Field of Classification Search
CPC ..... E06B 5/10; E06B 3/30; E06B 5/11
USPC ..... 52/202, 203, DIG. 12; 49/62, 463
See application file for complete search history.

(56) References Cited

U.S. PATENT DOCUMENTS

| | | | | |
|---|---|---|---|---|
| 1,710,108 | A | 4/1929 | Wilson | |
| 2,244,432 | A * | 6/1941 | Schwab | E06B 9/04 49/465 |
| 2,282,061 | A | 5/1942 | Jasperson | |
| 2,473,217 | A | 6/1949 | Peoples | |
| 2,675,071 | A | 4/1954 | Humphrey | |
| 2,777,174 | A | 1/1957 | Carr | |
| 3,356,404 | A | 12/1967 | Peters | |
| 3,516,215 | A | 6/1970 | Day | |
| 4,203,256 | A * | 5/1980 | Mowry | E06B 3/28 49/465 |
| 4,562,666 | A | 1/1986 | Young | |
| 4,680,915 | A * | 7/1987 | Bush | E06B 3/5481 248/504 |
| 5,110,234 | A | 5/1992 | Makinen | |
| 5,325,630 | A * | 7/1994 | Allenbaugh | E06B 7/28 49/463 |
| 5,343,668 | A | 9/1994 | Gonzalez | |
| 5,457,921 | A | 10/1995 | Kostrzecha | |
| 5,507,118 | A | 4/1996 | Brown | |
| 5,673,883 | A | 10/1997 | Figueroa | |
| 5,722,206 | A | 3/1998 | McDonald | |

(Continued)

*Primary Examiner* — Adriana Figueroa
(74) *Attorney, Agent, or Firm* — Brian S. Steinberger; Law Offices of Brian S. Steinberger, P.A.

(57) ABSTRACT

Systems, devices, apparatus, kits and methods of attaching transparent rigid plastic panels over door and window openings of vacant and/or damaged buildings and houses, that can include generally uniform thickness flange brackets which are attached to both the panels and both sides of the openings.

20 Claims, 6 Drawing Sheets

(56) References Cited

U.S. PATENT DOCUMENTS

| | | | | |
|---|---|---|---|---|
| 6,293,059 | B1 * | 9/2001 | Goodwin | E06B 9/02 52/202 |
| 6,314,690 | B1 | 11/2001 | Lilie | |
| 6,330,768 | B1 | 12/2001 | Rodrigues | |
| 6,502,355 | B1 * | 1/2003 | Bori | E06B 5/12 248/110 |
| 6,532,704 | B2 | 3/2003 | Hart | |
| 6,910,312 | B2 | 6/2005 | Whitworth | |
| 6,968,660 | B1 | 11/2005 | Novoa | |
| 6,978,579 | B1 * | 12/2005 | Trinca | E06B 9/02 49/50 |
| 7,748,168 | B2 | 7/2010 | Ferrara | |
| 7,805,898 | B1 * | 10/2010 | Everitt | E06B 9/02 49/50 |
| 8,074,408 | B1 | 12/2011 | Motosko | |
| 8,297,011 | B2 | 10/2012 | Quick | |
| 8,371,054 | B2 | 2/2013 | Casterline | |
| 8,490,346 | B2 | 7/2013 | Wedren | |
| 8,656,664 | B2 | 2/2014 | Glass | |
| 8,756,883 | B2 | 6/2014 | Glass | |
| 2004/0250475 | A1 | 12/2004 | Seaman | |
| 2006/0179735 | A1 | 8/2006 | McNelis | |
| 2006/0179736 | A1 * | 8/2006 | Bieber | E06B 9/02 52/202 |
| 2007/0204535 | A1 | 9/2007 | Hughes | |
| 2009/0133341 | A1 * | 5/2009 | Kontos | E04F 13/0812 52/202 |
| 2010/0236166 | A1 | 9/2010 | Tucker | |
| 2010/0269433 | A1 | 10/2010 | Westra | |
| 2012/0073201 | A1 | 3/2012 | Duffany | |
| 2013/0239497 | A1 | 9/2013 | Burleson | |

* cited by examiner

TRIANGULAR FLANGE BRACKET FOR ATTACHING CORNERS OF TRANSPARENT PLASTIC PANELS OVER WINDOWS AND DOOR OPENINGS

This application is a Continuation Application of U.S. patent application Ser. No. 14/583,400 filed Dec. 26, 2014, now U.S. Pat. No. 9,217,276, which claims the benefit of priority to U.S. Provisional Patent Application Ser. No. 61/921,213 filed Dec. 27, 2013. The entire disclosure of each of the applications listed in this paragraph are incorporated herein by specific reference thereto.

FIELD OF INVENTION

This invention relates to securing openings, and in particular to systems, devices, apparatus, kits and methods of attaching transparent plastic panels over door and window openings of vacant and/or damaged buildings and houses, with flange brackets which are attached to both the panels and adjacent frames and casings about lower corners of the openings.

BACKGROUND AND PRIOR ART

In the last decade, there has been an increase in the number of buildings and houses, where the property owner has left the property due to property owners defaulting on loans that exceed the actual value of the property, and/or leaving properties that have been damaged by storms, or vandalism, and the like. As such, lenders and mortgage companies have the need for property preservation to secure the empty and vacant buildings and houses.

Vacant structures occasionally have broken windows, which can be an attractive nuisance for vagrants, criminals and children and can result in thefts and destruction of interiors of the structures, as well as be unsafe and dangerous to persons entering the property Boarding up openings with plywood and traditional shutters, can be both expensive, and time consuming. Additionally, using fasteners, such as nails, screws, and/or bolts to directly attach boards and shutters can cause further damage to the property.

Additionally, boards and shutters are generally opaque and do not allow light therethrough. As such, the interiors of the structures are darkened which can result in further problems by having darkened interiors at all times.

Furthermore, the use of boards and shutters gives an immediate indication to a passerby that the property is vacant, which further attracts vagrants, criminals and children that can cause undesirable problems such as damage to the property.

Still furthermore, the appearance of boarded up windows and opaque shutters are both unsightly and can lower the property values for the buildings and houses.

As such, there exists a need to allow for simple and easy securing of the buildings and houses for property preservation. Additionally, there is a need for securing openings to the property with panels that are transparent and let light into the structures, and can give the appearance of the property not being vacant.

Thus, the need exists for solutions to the above problems with the prior art.

SUMMARY OF THE INVENTION

A primary objective of the present invention is to provide systems, devices, apparatus, kits and methods of attaching transparent plastic panels over door and window openings of vacant and/or damaged buildings and houses, with flange brackets which are attached to both the panels and adjacent frames about the openings.

A secondary objective of the present invention is to provide systems, devices, apparatus, kits and methods for securing openings such as windows and doors of vacant and/or damaged buildings and houses that can be easily attached without causing permanent damage to the openings.

A third objective of the present invention is to provide systems, devices, apparatus, kits and methods for securing openings such as windows and doors of vacant and/or damaged buildings and houses that are easily and inexpensively attached to the openings.

A fourth objective of the present invention is to provide systems, devices, apparatus, kits and methods for securing openings such as windows and doors of vacant and/or damaged buildings and housings, using transparent panels to allow light inside.

A fifth objective of the present invention is to provide systems, devices, apparatus, kits and methods for securing openings such as windows and doors of vacant and/or damaged buildings and houses, that give the appearance of the openings not being vacant nor boarded up or closed with shutters.

A sixth objective of the present invention is to provide systems, devices, apparatus, kits and methods for securing openings such as windows and doors of vacant and/or damaged buildings and houses, that are not unsightly and do not result in lowering of the property value of the buildings and houses.

A securing system for covering openings to buildings and housings, can include a rigid plastic panel sized to cover at least one exterior opening through a frame casing to a structure, at least one pair of rigid flange brackets sized to cover a lower left corner and a lower right corner of the plastic panel, and fasteners for attaching the plastic panel to the exterior of the structure opening so that the plastic panel is on an exterior side of the structure opening and the rigid flange brackets are on an interior side of the structure opening.

The plastic panel can be selected from at least one of a solid transparent acrylic material, a solid transparent resinous material, or a transparent polycarbonate material.

The rigid flange brackets can include a generally triangular shape. Each of the rigid flange brackets can include a long generally flat vertical side perpendicular to a shorter generally flat base, a flat top, and angled side which angles from the flat top angling downward at an angle to second flat vertical side which is shorter than the long flat side. The long flat side can have a length of approximately 5" to approximately 7", and the base can have a length of approximately 5" to approximately 7", the second side can have a length of approximately 2" to approximately 3", the flat top can have a length of approximately 2" to approximately 3", and an angled side of approximately 4 and ½" to approximately 5 and ½". Each rigid flange bracket can include a central through-hole of approximately ½" diameter. Each rigid flange bracket can have a thickness of approximately ¼" to approximately ⅛" to approximately 3/16".

The rigid flange brackets can include materials selected from stainless steel, galvanized metal and aluminum. Each of the rigid flange brackets can be formed from transparent rigid plastic material identical to the transparent rigid plastic panel.

The structure opening can include a window with glass attached.

A method of securing openings on structures, can include the steps of sizing a rigid plastic panel to fit over an opening to a structure, providing at least a pair of rigid flange brackets, positioning the rigid transparent plastic panel over the exterior of the structure opening, positioning one of the rigid flange brackets to overlap over a lower left corner portion of an interior to the structure opening and over a portion of a lower left corner of a frame casing about the structure opening, positioning another one of the rigid flange brackets to overlap over a lower right corner portion of an interior to the structure opening and over a portion of a lower right corner of a frame casing about the structure opening, attaching the rigid flange brackets to the sized rigid plastic panel with fasteners, so that the structure opening is securely covered and protected by the rigid plastic panel.

A kit for covering openings to buildings and housings, can include a rigid plastic panel sized to cover at least one exterior opening through a frame casing to a structure, at least one pair of rigid generally triangular flange brackets sized to cover a lower left corner and a lower right corner of the plastic panel, and fasteners for attaching the plastic panel to the exterior of the structure opening so that the plastic panel is on an exterior side of the structure opening and the rigid flange brackets are on an interior side of the structure opening.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
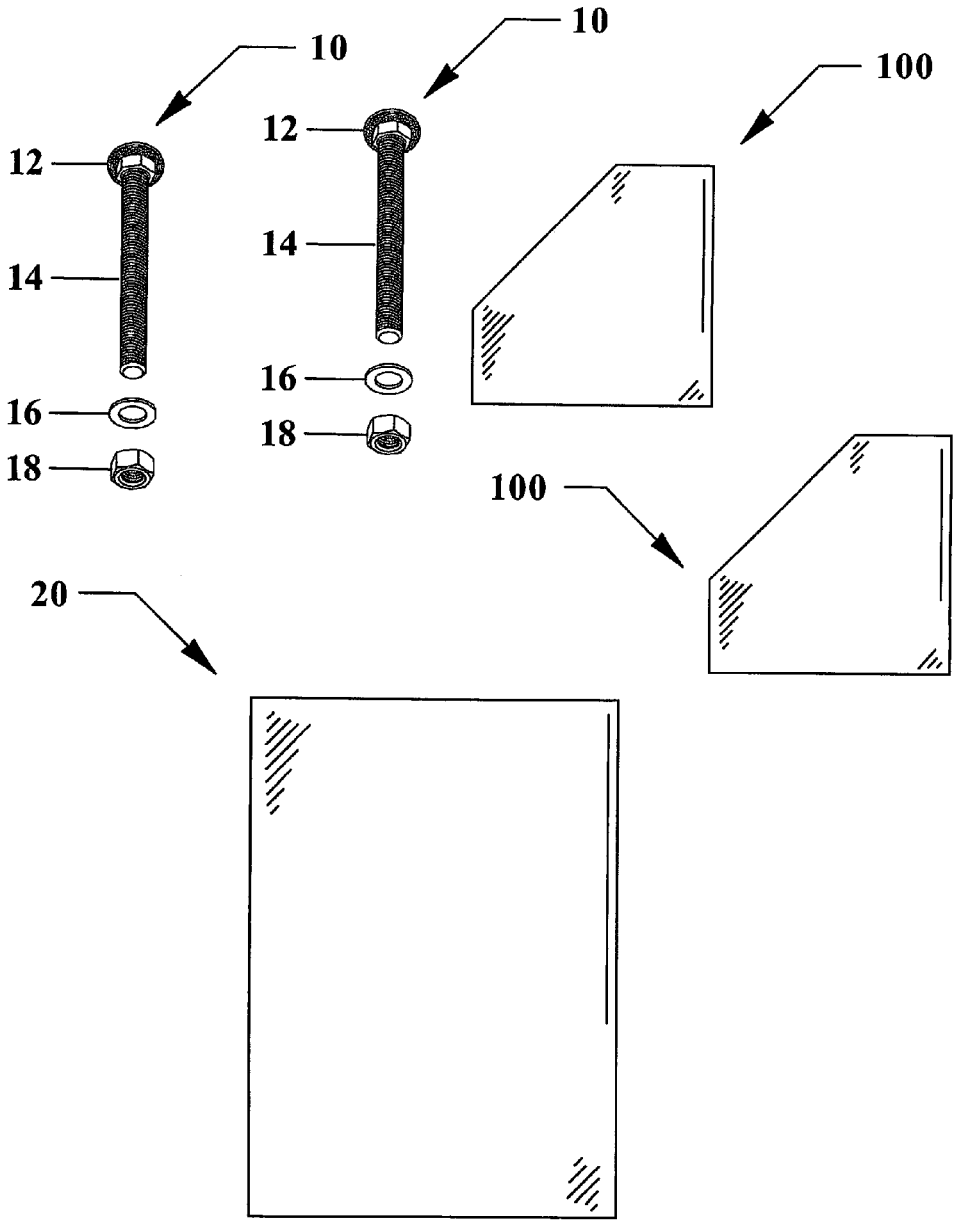
FIG. 1 is an exploded view of the novel triangular flanges with fasteners and plastic sheet for use with protecting window openings to a building or house.
Figure 2:
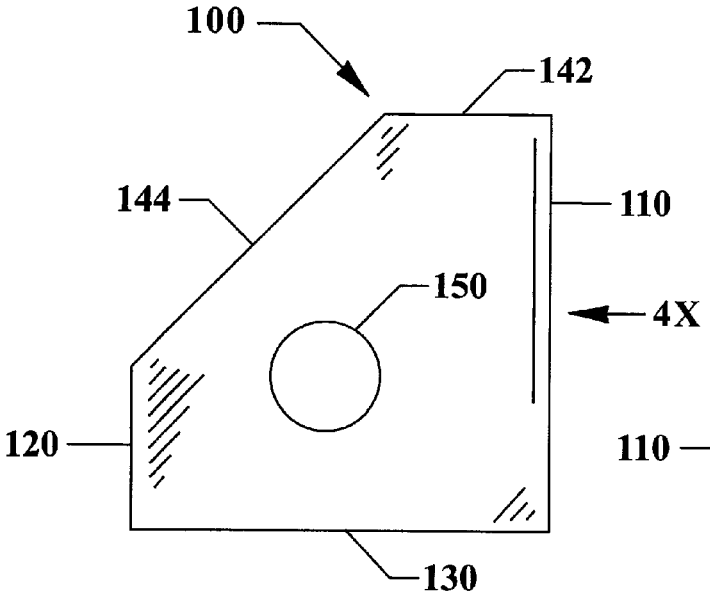
FIG. 2 is an enlarged front view of one the novel triangular flanges of FIG. 1.
Figure 4:
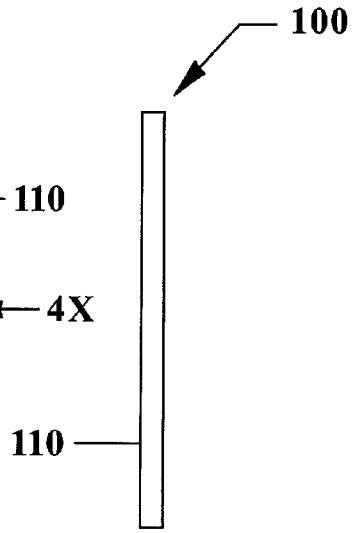
FIG. 4 is a side view of the triangular flange of FIG. 2 along arrow 4X.
Figure 3:
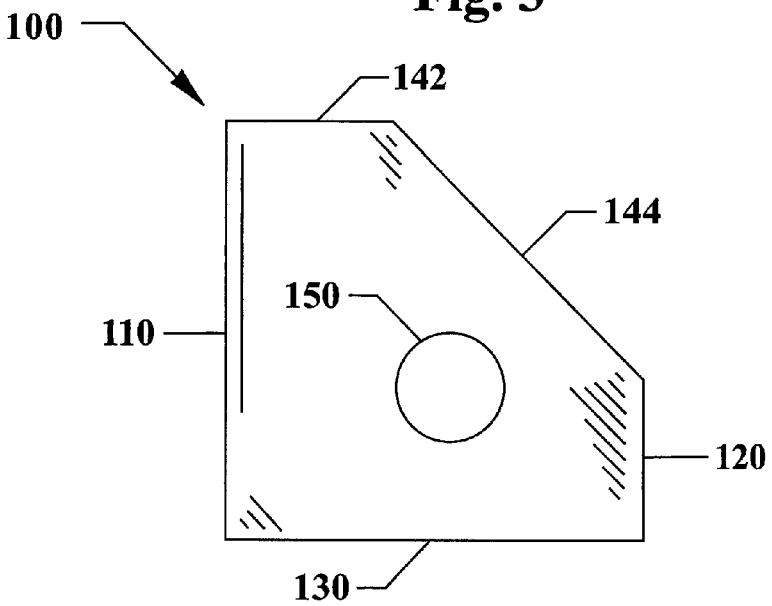
FIG. 3 is a rear view of the triangular flange of FIG. 2.

10 fasteners, such as bolts and screws
12 enlarged head of fastener(s)
14 threads
16 washer(s)
18 nut(s)
20 plastic sheet/panel
100 triangular flange(s)/bracket(s)
110 long side
120 short side
130 base
142 flat top
144 angled edge
150 through-hole
210 interior window frame/casing
220 exterior window opening
225. existing glass in window opening FIG. 1 is an exploded view of the novel triangular flanges/brackets 100 with fasteners 10 and plastic panel/sheet 20 for use with protecting window openings to a building or house. FIG. 2 is an enlarged front view of one the novel triangular flanges/brackets 100 of FIG. 1. FIG. 3 is a rear view of the triangular flange/bracket 100 of FIG. 2. FIG. 4 is a side view of the triangular flange/bracket 100 of FIG. 2 along arrow 4X.

Referring to FIGS. 1-4, a kit can include a pair of fasteners 10, can be bolts with enlarged heads 12, threads 14, washer(s) 16 and nut(s), a pair of triangular flanges/brackets 100, and a rigid plastic sheet/panel 20.

The panel/sheet 20 can be formed from a rigid material, such as polycarbonate. The panel/sheet 20 can be formed from a rigid transparent plastic, such as but not limited to a solid transparent acrylic material, a solid transparent resinous material, or a transparent polycarbonate material, such as those sold under the trade names of LEXAN®, PLEXIGLASS® and the like, can be used.

Each of the novel triangular flanges/brackets 100 can be generally right angled with long sides 110 of approximately 5" to approximately 7", and a base 130 having a length of approximately 5" to approximately 7", a short side 120 length of approximately 2" to approximately 3", a flat top 142 length of approximately 2" to approximately 3", and an angled side 144 of approximately 4 and ½" to approximately 5 and ½"(an angle of approximately 45 degrees) and a central through-hole 150 of approximately ½" diameter. Each of the flanges/brackets 100 can have a thickness of approximately ¼" to approximately ⅛" to approximately 3/16".

The term approximately can include +/− ten percent of the value referenced. Other dimensions can be sized as needed.

The flanges/brackets 100 can be formed from rigid metal materials, such as but not limited to plastic, and metal such as but not limited to stainless steel, galvanized metal, aluminum, and the like. Additionally, the flange brackets can be formed from transparent material such as the same material used for the transparent rigid panels. The flange brackets can be solid materials, or honeycomb inside or hollow.

Figure 5:
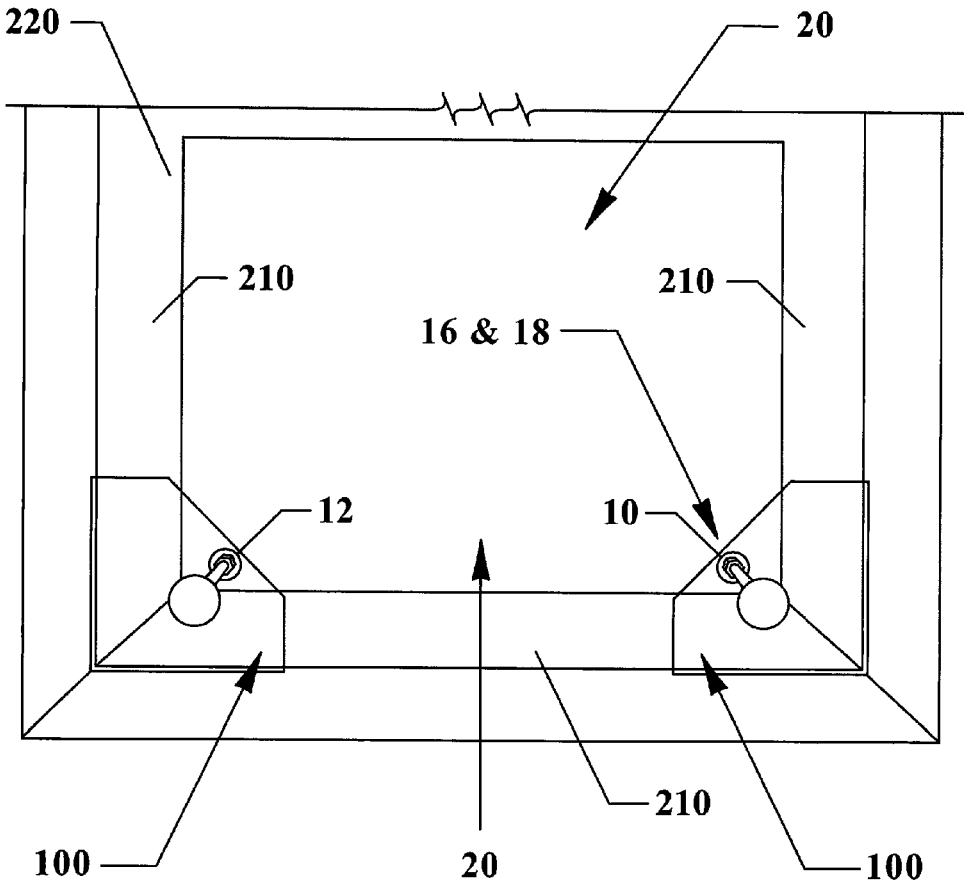
FIG. 5 is a partial perspective interior view of a window opening to a building or house with the triangular flanges on the interior lower corners over the window casing with the sheet panel on the exterior with the fasteners attaching the flanges to the sheet panel.
Figure 6:
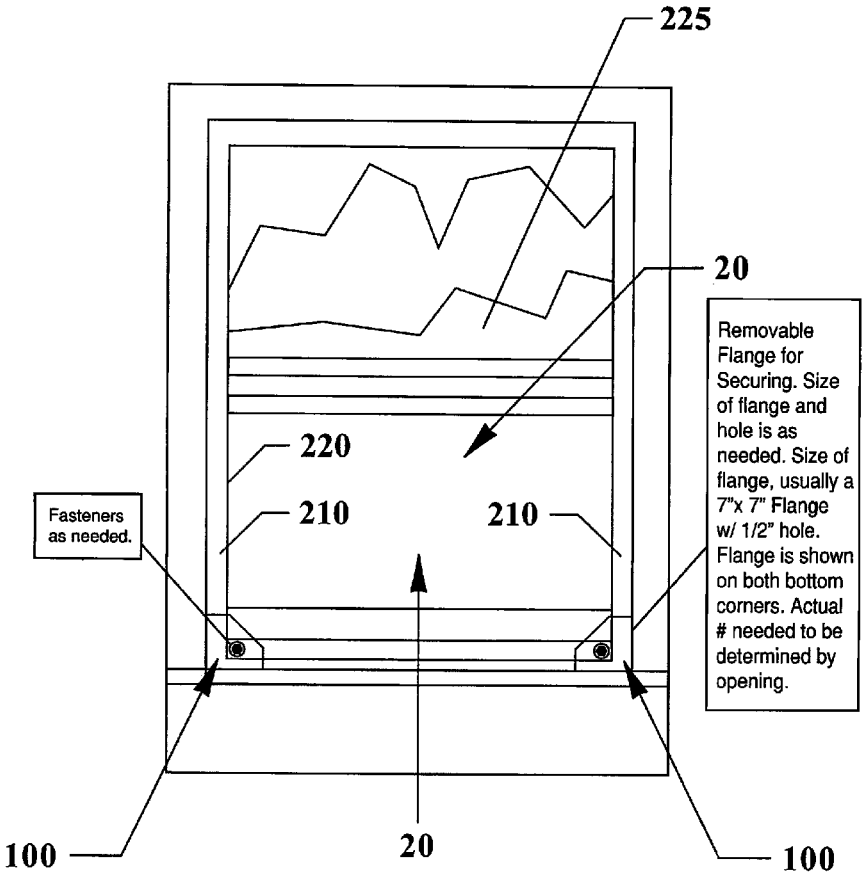
FIG. 6 is an interior view of the window opening with flanges and panel shown in FIG. 5.
Figure 7:
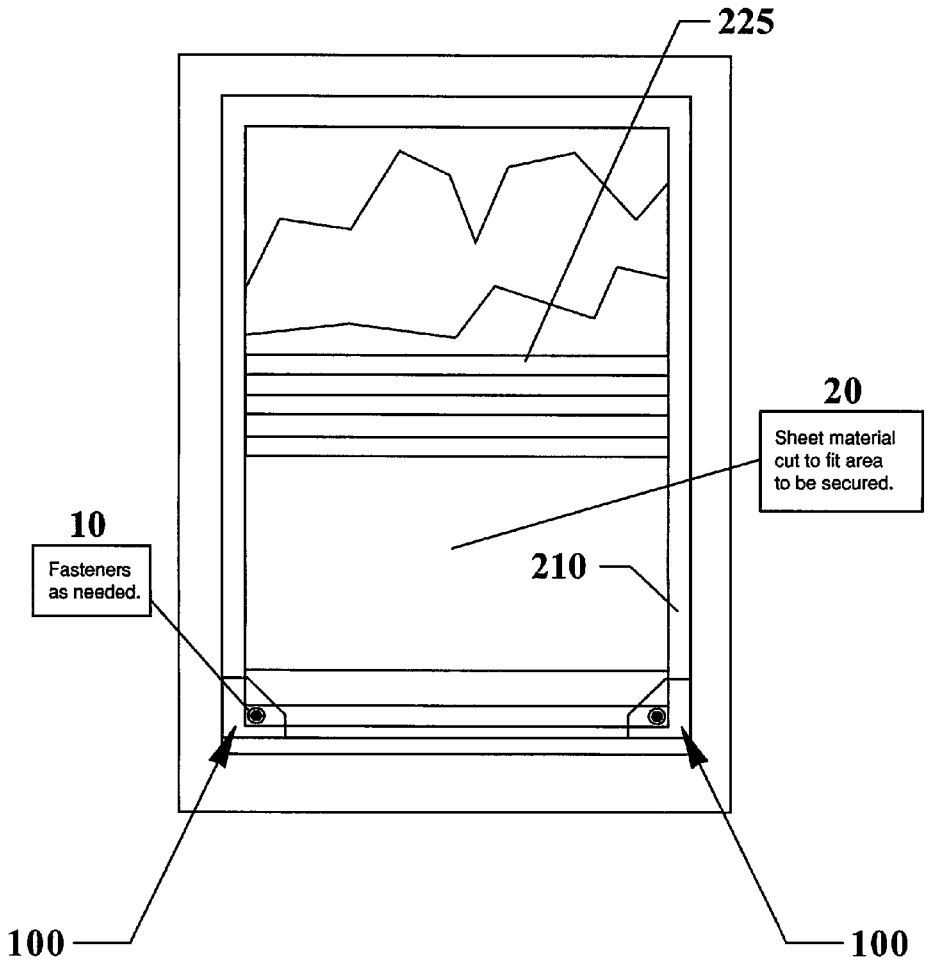
FIG. 7 is an exterior view of the window opening with flanges and panel shown in FIG. 5.

FIG. 5 is a partial perspective interior view of a window opening 220 to a building or house with the triangular flanges/brackets 100 on the interior lower corners over the window casing 210 with the sheet panel 20 on the exterior with the fasteners 10 attaching the flanges/brackets 100 to the sheet panel 20. FIG. 6 is an interior view of the window opening 220 with flanges/brackets 100 and panel 20 shown in FIG. 5. FIG. 7 is an exterior view of the window opening 220 with flanges/brackets 100 and panel 20 shown in FIG. 5.

Figure 8:
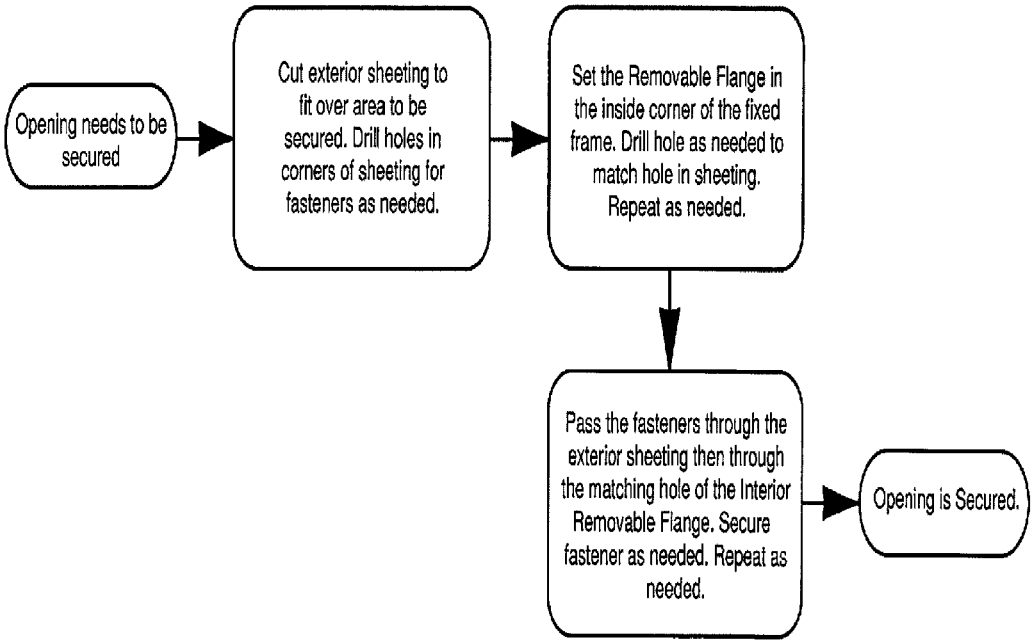
FIG. 8 is a flowchart of the installation steps to install a plastic panel over an opening shown in FIGS. 5-7, using the novel triangular flange brackets of FIGS. 1-3.

FIG. 8 is a flowchart of the installation steps to install a plastic panel over an opening shown in FIGS. 5-7, using the novel triangular flange brackets of FIGS. 1-3.

Referring to FIGS. 1-8, an opening 220, such as a window opening in a building structure or house structure having broken glass 225, needs to be secured. The novel invention can install rigid transparent plastic panels 20 over the exterior of window openings 220 using the novel triangular flanges/brackets 100.

The installer measures the window opening 220 to determine the size of the rigid transparent plastic panel 20 that is needed. The correct size can be cut to cover part or the entire glass area 225 of the window opening 220. Next, the installer places the cut panel 20 over the exterior of the glass area 225 of the window opening 220.

Next, the installer places the novel triangular flanges/brackets 100 on the bottom left and bottom right of the interior of the window opening, so that the triangular brackets overlap the frame or casing 210 of the window opening 220.

Next, the installer can drill holes 150 using a drill through the triangular flanges/brackets 100 and through the transparent plastic panels 20. A hole size 150 can be approximately ½ inch. Alternatively, the flanges/brackets 100 can have existing hole(s) therethrough. Next, fasteners 10 such as bolts with nuts and washers can be used to secure and sandwich portions of the frame/casing 210 of the window by the exterior positioned transparent plastic panel 20 using the triangular flanges/brackets 100 on the inside of the window opening 220. For example, the heads 12 of the bolts 10 can be on the exterior of the window opening 220 and the nuts 18 on the inside, where the nuts 18 are screwable and attach to the threads 14 of the fasteners 10. Alternatively, the bolt heads 12 can be on the inside and the nuts 18 on the outside. A locking washer(s) 16 can also be used with the fasteners 10. Additionally, other types of fasteners 10 can be used, such as but not limited to carriage bolts, and screws, and the like.

In the preferred embodiment, other generic types of fasteners 10, such as but not limited to bolts, screws and the like, can also be used on the top edge(s) of the transparent plastic panel 20 to attach the panel to the frame/casing 210, without using the novel triangular flanges/brackets 100. Additionally, the novel triangular flanges/brackets 100 can also be placed over the top right and top left upper casings 210 of the window opening 220 fastened to the transparent plastic panels 20 and similarly attached. The transparent rigid plastic panels 20 can be easily removed from the openings by reversing the installation steps referenced above.

The novel triangular flanges/brackets 100 are an extension to the inside from a corner(s) (flange) casing 210 of an opening 220 to a window or other object. The flange/bracket 100, of suitable size, shape, material and strength, placed over the corners of something to be covered, is intended to accept a threaded or unthreaded fastener in order to secure a cover over an opening. The novel triangular flanges/brackets 100 can utilize holes 150 of suitable size, in line with holes drilled through the covering, to insert the above mentioned fastener.

The fastener will be passed through the primary surface, the covering, to be secured. A hole of suitable size is drilled through the primary surface to allow the fastener to pass through. A suitable stop is on, or must be placed on, the fastener to prevent it from going through the primary surface. The number of holes drilled, the position of the holes and the number of the novel triangular flange brackets used depends on the size of the opening to be covered and the type of covering material used. If the novel triangular flange brackets material is the same as the covering material, the flange is virtually invisible. This is especially true if clear material is used.

Although a triangular shape is described, the novel flanges/brackets 100 can have other shapes such as but not limited to other geometrical shapes and the like. A flat or other shaped object placed inside the opening where there is a stopping point such as a window with a frame/casing around glass. The object can be a large washer, and have sufficient strength and size for a hole to be drilled therethrough to accept the threaded end of a bolt or screw. Washers and/or nuts can also be used to tighten and secure the outside covering against the flange brackets, thereby making the opposite sides covering virtually immovable except by loosening the nuts from the flange side. The novel flanges/brackets can be made from metal as described above or from the same material as the transparent rigid plastic panels.

Although the openings described in the preferred embodiment in relation to the Figures show window openings, the invention can be used with other openings, such as but not limited to openings for doors and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A securing system for covering openings to buildings and housings, comprising:

a rigid rectangular panel covering an exterior opening in a frame casing to a structure, the rigid rectangular panel having left corners that include an upper left corner and a lower left corner, and right corners that include an upper right corner and a lower right corner, each of the left and right corners having a vertical edge and a horizontal edge;

at least two one pair of separated and individually mountable rigid flange brackets, at least one of the brackets sized to cover and overlap both the vertical edge and horizontal edge of at least one of the left corners of the rigid rectangular panel and at least another of the brackets sized to cover and overlap both the vertical edge and horizontal edge of at least one of the right corners of the rigid rectangular panel, each of the rigid flange brackets consisting of a generally planar configuration with a generally uniform thickness, each of the rigid flange brackets having an opening therethrough consisting of a single through-hole; and fasteners for attaching the rigid rectangular panel to the exterior of a structure opening so that the rigid rectangular panel is on an exterior side of the structure opening and the rigid flange brackets are on an interior side of the structure opening;

wherein the fasteners pass through openings in the rigid rectangular panel.

2. The securing system of claim 1, wherein the rigid panel is selected from at least one of: a solid transparent acrylic material, a solid transparent resinous material, or a transparent polycarbonate material.

3. The securing system of claim 1, wherein each of the rigid flange brackets includes a geometrical shape with flat sides.

4. The securing system of claim 1, wherein each of the rigid flange brackets includes a generally triangular shape with flat sides.

5. The securing system of claim 1, wherein each of the brackets is selected from at least one of: a solid transparent acrylic material, a solid transparent resinous material, or a transparent polycarbonate material.

6. The securing system of claim 1, wherein the single through-hole in each rigid flange bracket includes: a diameter of approximately ½" diameter.

7. The securing system of claim 4, wherein each rigid flange bracket includes:

a thickness of approximately ¼" to approximately ⅛" to approximately 3/16".

8. The securing system of claim 1, wherein the rigid flange brackets include materials selected from stainless steel, galvanized metal and aluminum.

9. The securing system of claim 1, wherein the rigid flange brackets are formed from rigid material identical to the rigid panel.

10. The securing system of claim 1, wherein the structure opening includes:

a window having glass attached to the frame casing.

11. A method of securing openings on structures, comprising the steps of:

sizing a rigid rectangular panel to fit over an opening to a structure, the rigid rectangular panel having left corners that include an upper left corner and a lower left corner, and right corners that include an upper right corner and a lower right corner, each of the left and right corners having a vertical edge and a horizontal edge;

providing at least two separated and individually mountable a pair of rigid flange brackets, each of the brackets consisting of a generally planar configuration with a generally uniform thickness;

providing each of the rigid flange brackets with an opening therethrough consisting of a single through-hole;

positioning the sized rigid panel over the exterior of the structure opening;

positioning one of the rigid flange brackets to overlap over a left corner portion of an interior to the structure opening and over a portion of a left corner of a frame casing about the structure opening, and so that the one of the rigid flange brackets will cover and overlap both the vertical edge and horizontal edge of at least one of the left corners of the rigid rectangular panel;

positioning another one of the rigid flange brackets to overlap over a right corner portion of an interior to the structure opening and over a portion of a right corner of a frame casing about the structure opening, and so that the another one of the rigid flange brackets will cover and overlap both the vertical edge and horizontal edge of at least one of the right corners of the rigid rectangular panel; and attaching the rigid flange brackets to the sized rigid panel with fasteners through each of the single through-holes, so that the structure opening is securely covered and protected by the sized rigid panel; wherein the fasteners pass through openings in the rigid rectangular panel.

12. The method of claim 11, wherein each of the flange brackets includes:

a generally triangular shape with flat sides.

13. The method of claim 11, wherein each of the flange brackets includes:

a geometrical shape with flat sides.

14. The method of claim 11, further comprising the step of:

forming the rigid panel from at least one of: a solid transparent acrylic material, a solid transparent resinous material, or a transparent polycarbonate material.

15. The method of claim 11, further comprising the step of:

forming each of the brackets from at least one of: a solid transparent acrylic material, a solid transparent resinous material, or a transparent polycarbonate material.

16. The method of claim 11, wherein the single through-hole in each rigid flange bracket includes: a diameter of approximately ½" diameter.

17. The method of claim 11, wherein each rigid flange bracket includes:

a thickness of approximately ¼" to approximately ⅛" to approximately 3/16".

18. The method of claim 11, wherein the rigid flange brackets are formed from rigid material identical to the sized rigid panel.

19. A kit for covering openings to buildings and housings, comprising:

a rigid rectangular panel sized to cover at least one exterior opening through a frame casing to a structure; the rigid rectangular panel having left corners that include an upper left corner and a lower left corner, and right corners that include an upper right corner and a lower right corner, each of the left and right corners having a vertical edge and a horizontal edge at least two separated and individually mountable flange brackets, at least one of the brackets sized to cover and overlap both the vertical edge and horizontal edge of at least one of the left corners of the rigid rectangular panel and at least another of the brackets sized to cover and overlap both the vertical edge and horizontal edge of at least one of the right corners of the rigid rectangular panel, and each of the rigid flange brackets having an opening therethrough consisting of a single through-hole; and fasteners for attaching the rigid rectangular panel to the exterior of a structure opening through each of the single through-holes in the brackets so that the rigid rectangular panel is on an exterior side of the structure opening and the rigid flange brackets are on an interior side of the structure opening; wherein the fasteners pass through openings in the rigid rectangular panel.

20. The kit of claim 19, wherein each rigid flange bracket includes:

a thickness of approximately ¼" to approximately ⅛" to approximately 3/16".

* * * * *